US005105712A

United States Patent [19]

Rosenberg et al.

[11] Patent Number: 5,105,712

[45] Date of Patent: Apr. 21, 1992

[54] APPARATUS FOR CLEARING SCATTERED MINES

[75] Inventors: Victor Rosenberg, Meytar; Emanuel Broitman; Abraham Hyams, both of Beersheva, all of Israel

[73] Assignee: Israel Aircraft Industries Ltd., Lod, Israel

[21] Appl. No.: 694,956

[22] Filed: Apr. 30, 1991

[30] Foreign Application Priority Data

Jul. 10, 1990 [IL] Israel ..... 95035

[51] Int. Cl.[5] ..... F41H 11/12

[52] U.S. Cl. ..... 89/1.13

[58] Field of Search ..... 89/1.13; 171/141

[56] References Cited

U.S. PATENT DOCUMENTS

| | | | |
|---|---|---|---|
| 2,425,357 | 8/1947 | Walker | 89/1.13 |
| 2,460,322 | 2/1949 | Walker | 89/1.13 |
| 2,486,372 | 10/1949 | Rockwell | 89/1.13 |
| 2,489,340 | 11/1949 | White | 89/1.13 |
| 3,771,413 | 11/1973 | Sieg et al. | 89/1.13 |
| 4,467,694 | 8/1984 | Azulai et al. | 89/1.13 |
| 4,491,053 | 1/1985 | Bar-Nefy et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,667,564 | 5/1987 | Schreckenberg | 89/1.13 |
| 4,690,030 | 9/1987 | Bar-Nefy et al. | 89/1.13 |
| 4,727,940 | 3/1988 | Bar-Nefy et al. | 171/84 |
| 4,938,114 | 7/1990 | Matthews et al. | 89/1.13 |

FOREIGN PATENT DOCUMENTS

| | | |
|---|---|---|
| 1204283 | 5/1986 | Canada . |
| 1205426 | 6/1986 | Canada . |
| 0071384 | 2/1983 | European Pat. Off. . |
| 0094901 | 11/1983 | European Pat. Off. . |
| 8363008 | 11/1983 | European Pat. Off. . |
| 0115738 | 12/1983 | European Pat. Off. . |
| 8230379 | 5/1986 | European Pat. Off. . |
| 2430709 | 1/1976 | Fed. Rep. of Germany . |
| 2632568 | 1/1978 | Fed. Rep. of Germany . |
| 914285 | 10/1946 | France . |
| 67438 | 12/1983 | Israel . |
| 2106454 | 4/1983 | United Kingdom . |

OTHER PUBLICATIONS

Jane's Combat Support Equipment, Ed. C. F. Foss, Janes Yearbooks, London, p. 178, 1978–79.

Minenraum-Anbaugerat KMT-5, Soldat und Technik Apr. 1976, pp. 176–178.

*Primary Examiner*—David H. Brown

*Attorney, Agent, or Firm*—Charles Berman

[57] ABSTRACT

Vehicle mountable apparatus for clearing mines located on a pavement surface including one or more tensioned elongate members, mounted onto a vehicle travelling along the pavement surface in a travel direction. The tensioned elongate members are operative to engage mines located on the pavement surface in the path of the vehicle so as to propel them away from the vehicle in a direction transverse to the travel direction, thereby clearing a safely traversable path along the pavement surface. Vehicle mountable apparatus for clearing mines buried in a mine field may also be provided in association with the apparatus for clearing mines located on a pavement surface.

13 Claims, 9 Drawing Sheets

APPARATUS FOR CLEARING SCATTERED MINES

FIELD OF THE INVENTION

The present invention relates to vehicle mountable mine clearing apparatus in general and, more particulary, to vehicle mountable apparatus for clearing a safely traversable path along a pavement surface strewn with scattered mines.

BACKGROUND OF THE INVENTION

In modern warfare it is known to deploy 'scattered' mines, e.g. via artillery shells, on hard pavement or road surfaces, particularly those along which main supply lines are maintained.

As these pavement surfaces are normally road or bridge surfaces, scattered mines cannot be cleared therefrom by apparatus such as the 'plowing' system descibed in U.S. Pat. No. 4,467,694, nor is it desirable to attempt to detonate the mines as this would cause severe damage to the pavement surface.

Furthermore, scattered mines are generally of the variety that is activated when engaged under a relatively small force, such that it is necessary to propel them away from the pavement surface at a relatively high speed, so that when they explode they will be out of range so as not to damage the pavement or personnel or vehicles seeking to travel thereacross.

SUMMARY OF THE INVENTION

It is an aim of the present invention to provide vehicle mountable apparatus for clearing a safely traversable path along a pavement surface strewn with scattered mines.

There is provided, therefore, in accordance with an embodiment of the invention, vehicle mountable apparatus for clearing mines located on a pavement surface including one or more tensioned elongate members, mounted onto a vehicle travelling along the pavement surface in a travel direction, for engaging mines located on the pavement surface in the path of the vehicle so as to propel them away from the vehicle in a direction transverse to the travel direction, thereby clearing a safely traversable path along the pavement surface.

According to a further embodiment of the invention, there is provided mobile apparatus for clearing mines located on a pavement surface including a vehicle operative to travel across the pavement surface in a travel direction; and one or more tensioned elongate members, mounted onto the vehicle, for engaging mines located on the pavement surface in the path of the vehicle so as to propel them away from the vehicle in direction transverse to the travel direction, thereby clearing a safely traversable path along the pavement surface.

According to an additional embodiment of the invention, there is provided vehicle mountable mine clearing apparatus including apparatus configured for mounting onto a vehicle for clearing mines buried in a mine field; and apparatus, mountable in association with the vehicle, for clearing mines located on a pavement surface.

Additionally in accordance with the present embodiment, the apparatus for clearing mines located on a pavement surface is mounted onto the apparatus for clearing buried mines.

Further in accordance with the present embodiment, the apparatus for clearing mines located on a pavement surface is operative, when the vehicle travels along the pavement surface in a travel direction, to engage mines located on the pavement surface in the path of the vehicle so as to propel then away from the vehicle in a direction transverse to the travel direction, thereby clearing a safely traversable path along the pavement surface.

Additionally in accordance with the present embodiment, the apparatus for engaging and propelling includes one or more tensioned elongate members; and apparatus for mounting the tensioned members onto the apparatus for clearing buried mines in a position parallel to the pavement surface, at a predetermined angular orientation relative to the travel direction, and at a height relative to the pavement surface that is no lower than a predetermined height thereabove.

BRIEF DESCRIPTION OF THE DRAWINGS

The present invention will be understood and appreciated more fully from the following detailed description taken in conjuction with the drawings in which.

DETAILED DESCRIPTION OF THE INVENTION

Figure 1:
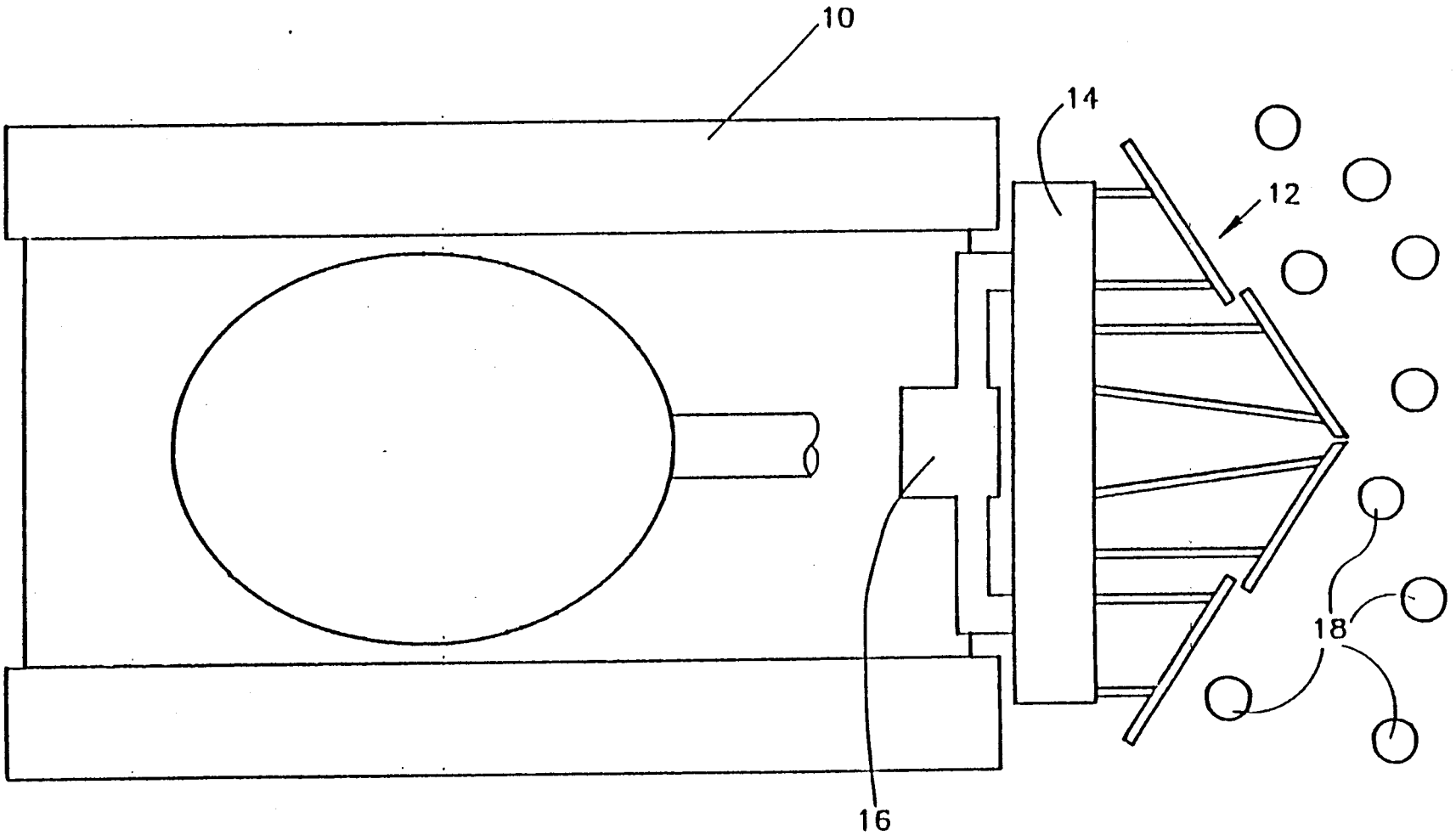
FIG. 1 is a schematic plan view illustration of a vehicle having mounted thereon apparatus for clearing scattered mines, constructed and operative in accordance with the present invention.

Reference is made to FIG. 1, in which there is schematically illustrated a vehicle 10, e.g. a main battle tank, having mounted thereon apparatus, referenced generally 12, for clearing scattered mines from a pavement surface, such as a highway. The mine clearing apparatus 12 is mounted, via appropriate support apparatus 14, onto the front of the vehicle 10. There is preferably also provided a lifting system 16, for lowering apparatus 12 towards a pavement surface into a position of potential engagement with mines 18 scattered thereon, and for raising apparatus 12 when it is not in use.

It will be appreciated that as the pavement surfaces on which scattered mines may be deployed are typically road or bridge surfaces, the mines cannot be cleared by a 'plowing' system such as described in U.S. Pat. No. 4,467,694, nor is it desirable to attempt to detonate the mines in situ, as this would cause severe damage to the pavement surface. Furthermore, scattered mines are generally of the variety that is activated by a relatively small force, such that it is necessary to propel then away from the pavement surface at a relatively high speed, so that when they explode they will be out of range of the pavement and personnel or vehicles seeking to travel thereacross.

Figure 2:
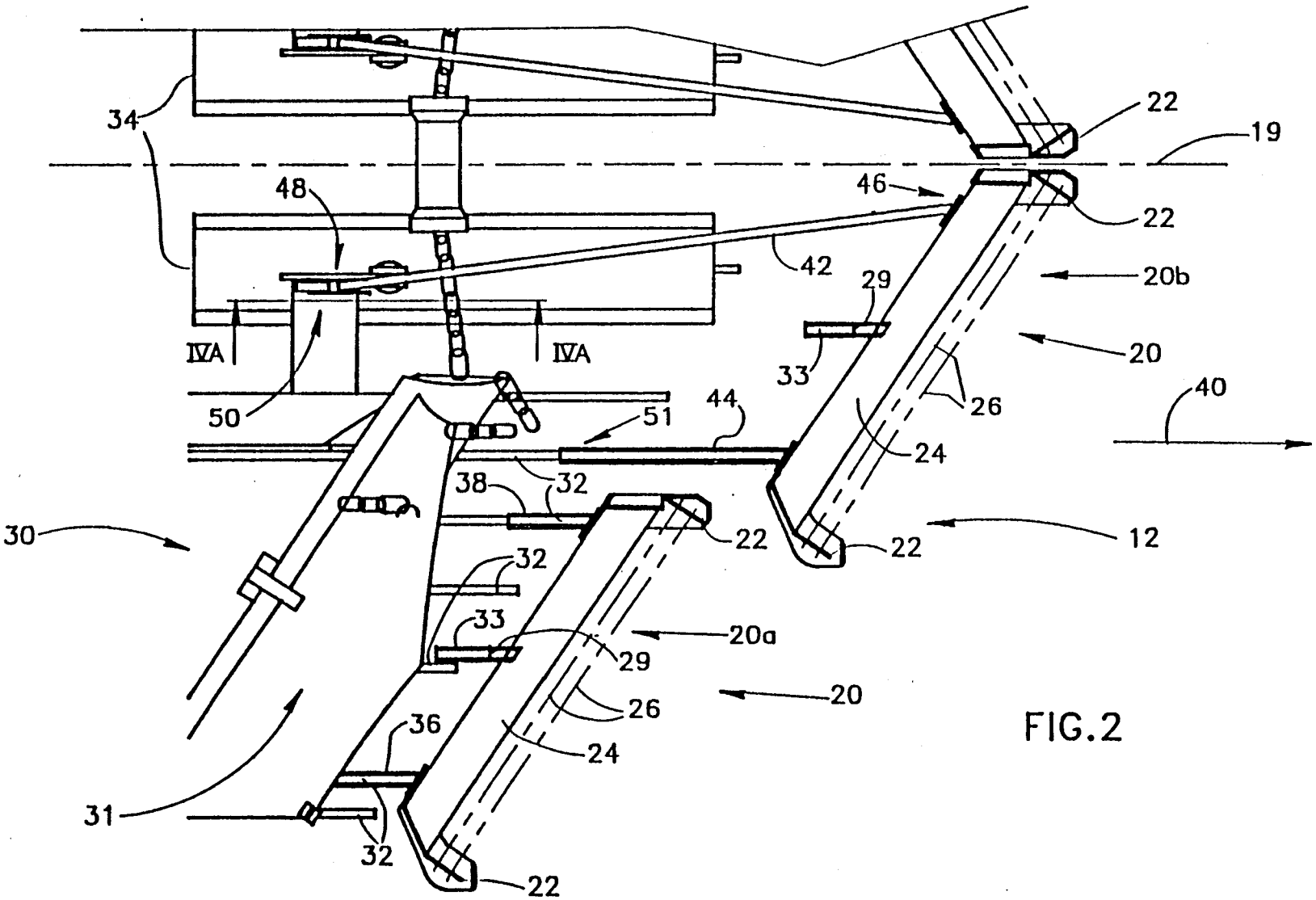
FIG. 2 is a detailed plan view of a portion of the mine clearing apparatus of FIG. 1, constructed according to one embodiment of the invention.

Reference is now made to FIG. 2, which is a plan view illustration of a portion of the mine clearing apparatus 12, constructed according to one embodiment of the invention. It will be appreciated thaat the illustrated mine clearing system is symmetrical about an axis 19. Apparatus 12 includes a plurality of mine clearing members 20 which are arranged so as to engage scattered mines laying on a pavement surface in the path of vehicle 10, across at least the entire width of the vehicle, and to propel the mines away from the vehicle so as to clear a safely traversable path along the pavement. Respective plan and front views of a single mine clearing member of the invention are shown in FIGS. 3A and 3B.

Figure 3A:
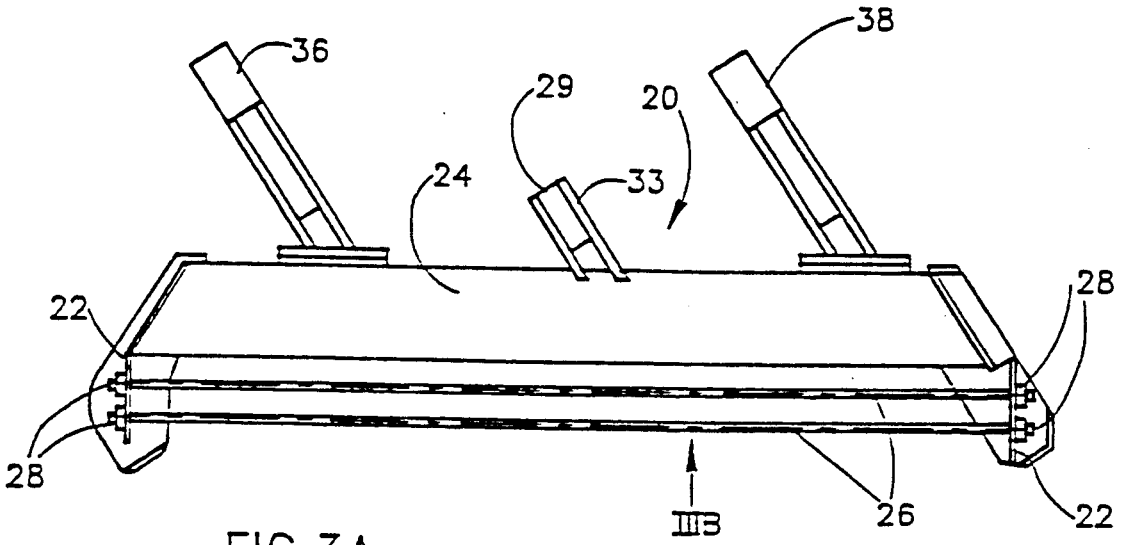
FIGS. 3A and 3B are respective plan and front views of a single mine clearing member illustrated in FIG. 2, the view of FIG. 3B being taken in the direction of arrow IIIB in FIG. 3A.
Figure 3B:
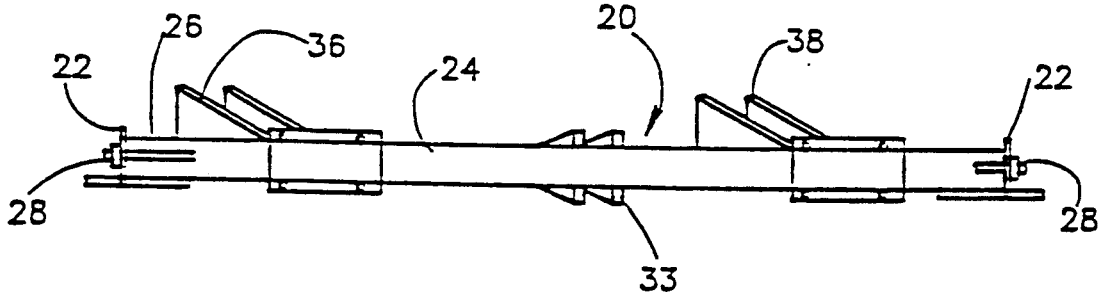

Referring now to FIGS. 3A and 3B, each member 20 includes a pair of mounting flanges 22 connected rigidly together via an elongate intermediate member 24. One or more tensioned elongate members 26 are mounted between the pair of mounting flanges 22 and are arranged such that when the mine clearing apparatus is in a lowered position, as illustrated in FIG. 5B, forward movement of the vehicle will cause engagement by an elongate member 26 of a mine laying in the path of the vehicle.

Figure 6:
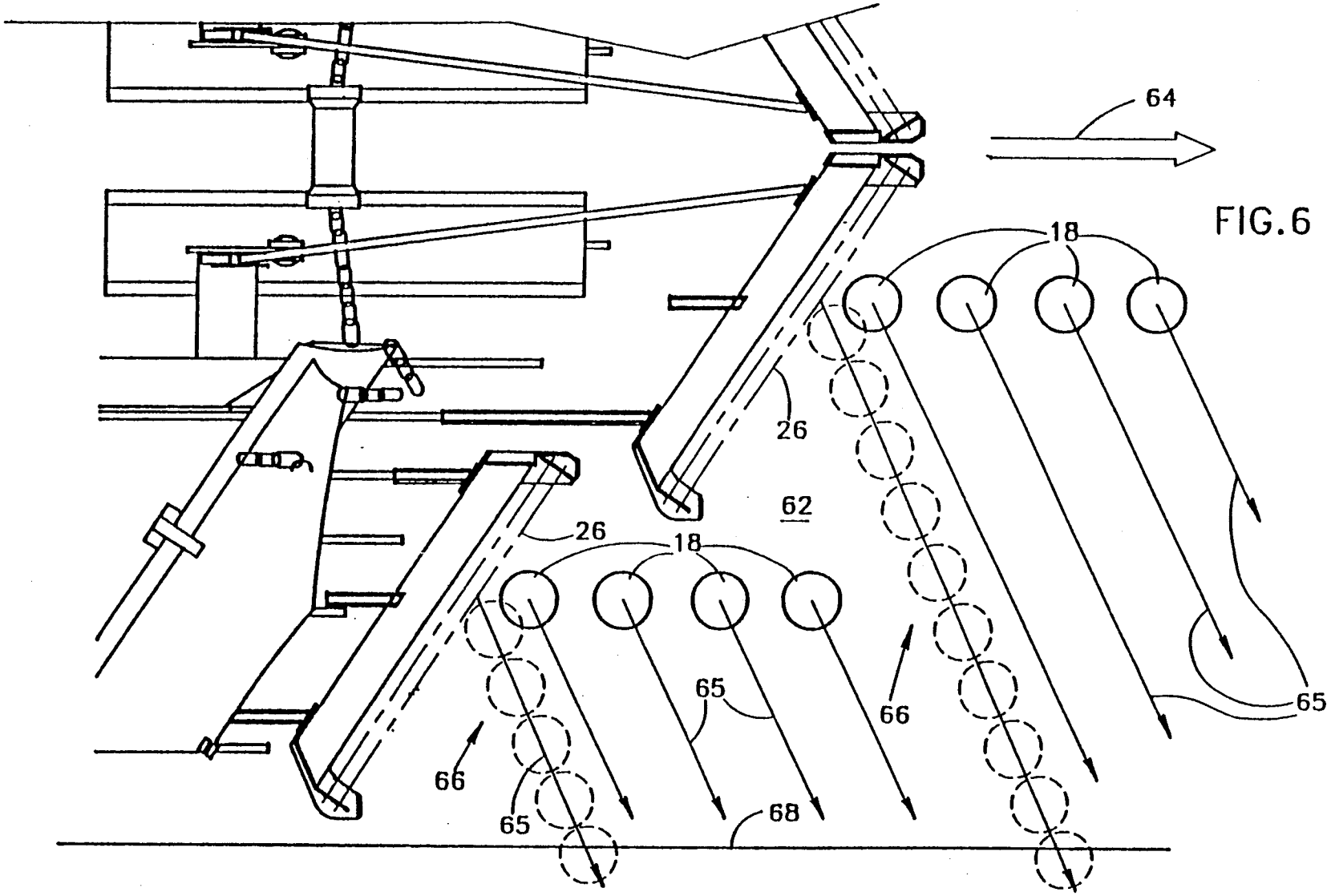
FIG. 6 is a partial plan view of the apparatus of FIGS. 2, 5A and 5B in operation.

Engagement of a mine by elongate member 26 when vehicle 10 is travelling at a normal road speed, typically 20–30 km/h, is operative to cause a sideways deflection of the engaged mine, as indicated schematically in FIG. 6. A mine thus engaged is operative to be propelled at a velocity typically of between 20–50 km/h such that although the impact with member 26 is sufficient to activate the mine, detonation thereof will not occur within range of the travel path of the vehicle.

Although generally any suitable type of tensionable member may be used for elongate members 26, it has been found that 5 mm 'piano wire' attached to flanges 22 and tensioned via nuts 28 (FIGS. 3A and 3B) is suitable for this purpose. In the present example, two elongate members 26 are provided, one behind the other, so as to provide a back-up member if the front member breaks during mine clearing operations.

With further reference to FIG. 2, in the present example, support apparatus 14 (FIG. 1) onto which apparatus 12 is mounted, is constituted by mine field plowing apparatus, referenced generally 30, (FIG. 2) such as described in U.S. Pat. No. 4,467,694, whose contents are incorporated herein by reference. Only minor modifications, as described below, need be made to the plowing apparatus 30, so as to facilitate mounting thereon of mine clearing apparatus 12. A particular advantage of this arrangement is that a tank, for example, is thus provided with a dual mine clearing capability, both of clearing conventional fields of buried mines (after removal of apparatus 12), and by use of apparatus 12 for the clearing of scattered mines from a pavement surface.

The mine field plowing apparatus includes right and left pluralities of plowing teeth 32, of which only the right plurality is illustrated. Skids 34, whose function is described below, are provided between the two pluralities of plowing teeth 32.

According to the embodiment illustrated in FIG. 2, an outside, right hand mine clearing member 20*a* is mounted onto plowing teeth 32, via bolted connections (not shown) between rigid, rear-facing brace members 36 and 38 (also FIGS. 3A and 3B), attached to members 20*a*, and predetermined teeth 32. The length of brace members 36 and 38 is selected so as to position elongate members 26 at an optimum angle relative to the direction of travel of the vehicle, indicated by an arrow 40. Members 26 are preferably oriented at approximately 45° relative to the direction of travel.

An inside right hand mine clearing member 20*b* is mounted onto plowing apparatus 30 via a rigid beam member 42 and an additional tooth-mounted brace member 44. Due to the more forward, overlapping position of mine clearing member 20*b* relative to the position of member 20*a*, in the present example, additional brace member 44 is longer than brace members 36 and 38.

Beam member 42 constitutes a second support for the mine clearing member 20*b* and is connected at a first end 46 to the mine clearing member and at a second end 48, via a shock absorbing mount 50, to a right hand skid 34. Brace member 44 is connected to a plowing tooth 32 via a shock absorbing mount 51 which is generally similar to shock absorbing mount 50. Mount 50 is described in detail below, in conjunction with FIGS. 4A–4C.

Each mine clearing member 20 has attached thereto a wheel 29, e.g. a metal wheel, (not seen in FIG. 3B) which is mounted via an intermediate brace 33 so as to retain member 20 at a predetermined height above a travel surface when the mine clearing apparatus is in an operational position.

Referriing now particularly to FIG. 5B, each skid 34, whose function, as described in U.S. Pat. No. 4,467,694, is to regulate the height of an associated plow section 31 (FIG. 2) relative to a ground surface, is, in the present embodiment, fitted with a wheel 35. Each wheel 35 is mounted for pivoting about a generally vertical axis 39 so as to ease travel over a pavement surface that is slightly damaged. Additionally, each wheel mounting 41 is preferably provided with a vertical damping facility, so as to reduce vertical vibrations that might otherwise be developed in the apparatus during travel. Wheel 35 may be any suitable type of pivot-mounted wheel with vertical damping, an example of a suitable wheel being that having Catalog No. 79373 and manufactured by GUITEL, P.O.B. 28, 30 Rue Carnot, 93310, Le Pre Saint Gervais, France.

Figure 4C:
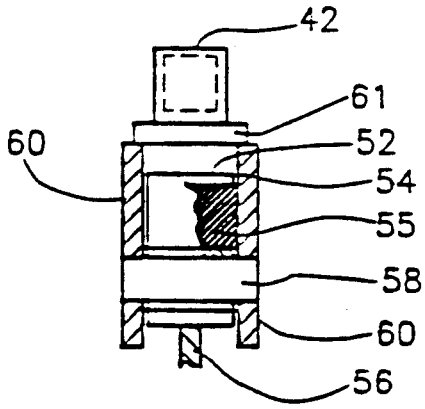
FIGS. 4A, 4B and 4C are respective side, top and sectional views of a shock absorber element illustrated in FIG. 2.
Figure 4B:
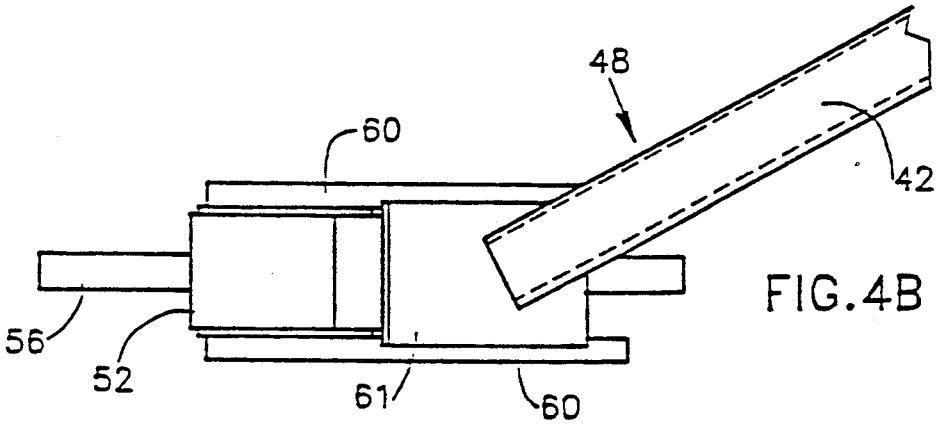
Figure 4A:
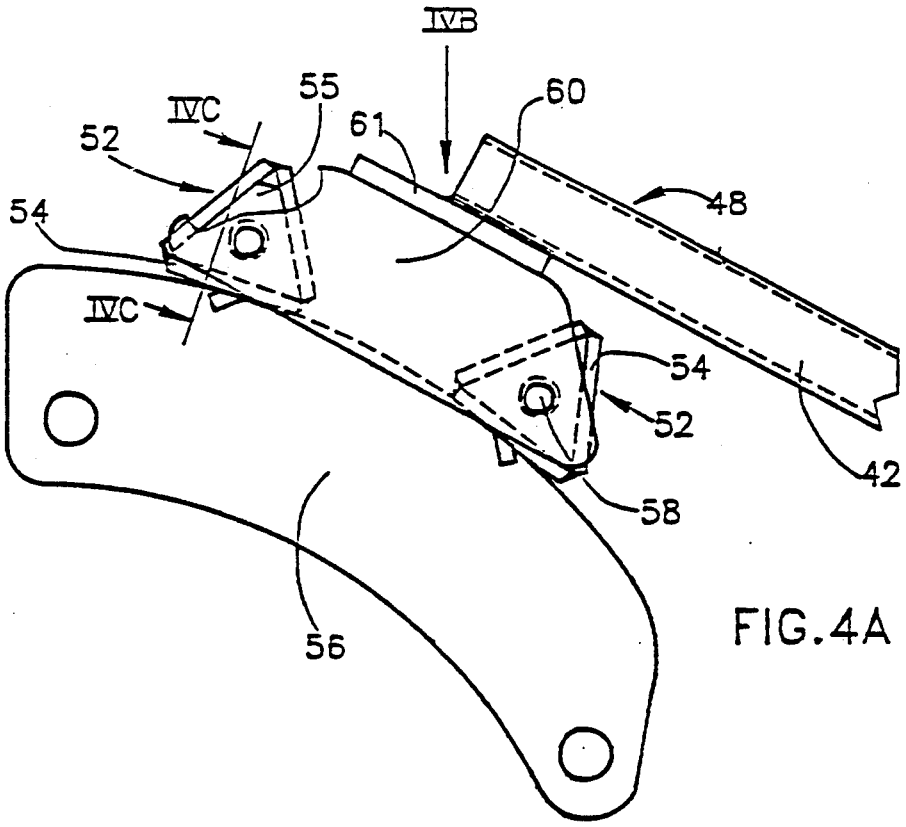

Reference is now made to FIGS. 4A–4C, in which shock absorbing mount 50 is illustrated in detail. Shock absorbing mount 51 is not described herein in detail as it is generally similar to mount 50. Mount 50 includes a pair of shock absorbing elements 52 having a rigid, typically metal outer casing 54, and an inner, resilient element 55 made, for example, of polyethylene having a hardness of typically about 95 shor. An example of a suitable material is marketed under the name FIBROFLEX (R).

Elements 52 are connected, as illustrated in FIG. 4C, as by welding, to a lower plate 56 which is mounted by any suitable means, onto skid 34. Elements 52 are also connected to second end 48 of beam member 42 via a pair of lugs or bolts 58 extending through lateral bores in respective resilient elements 55 and rigidly attached to side plates 60 connected to a cover plate 61 to which beam member 42 is rigidly attached as by welding.

Shock absorbing mounts 50 and 51 (FIG. 2) are operative to prevent the transmission of significant vibrations from the mine clearing apparatus to the vehicle, when it is being used for mine clearing operations.

Figure 5A:
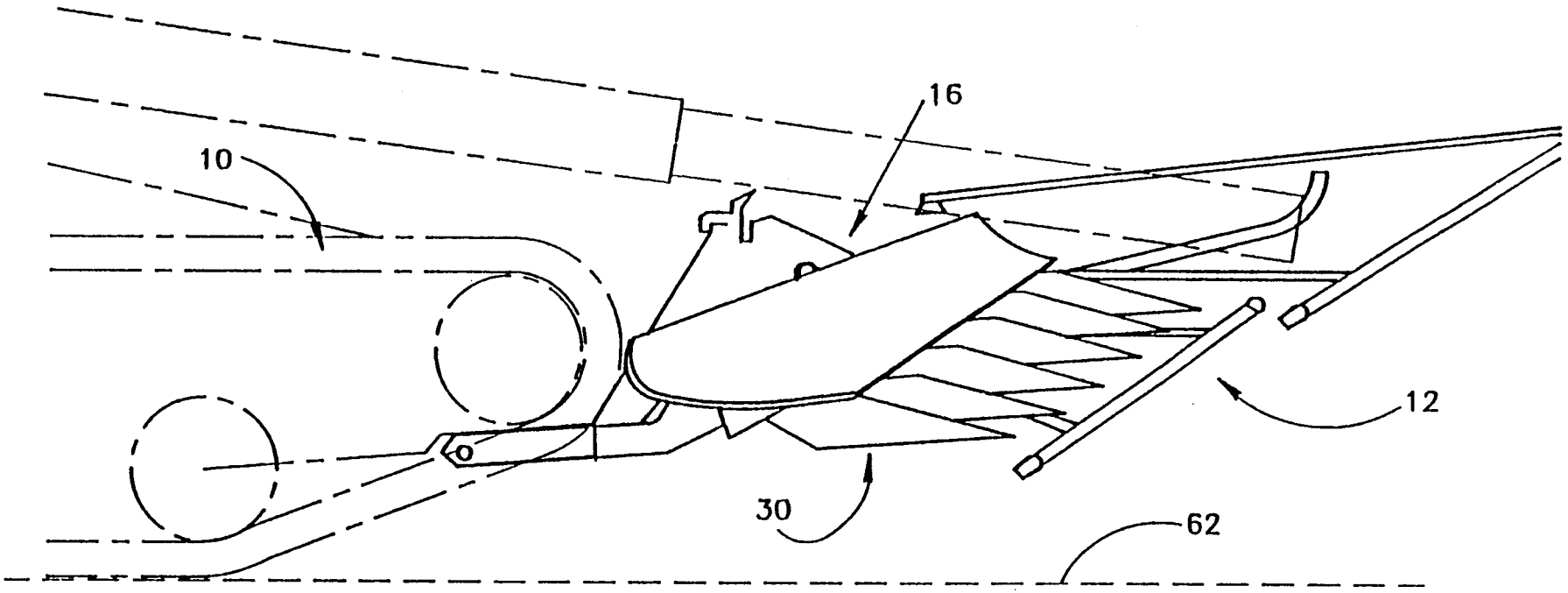
FIGS. 5A and 5B are schematic side view illustrations of the apparatus of FIG. 2 in respective raised and lowered positions.
Figure 5B:
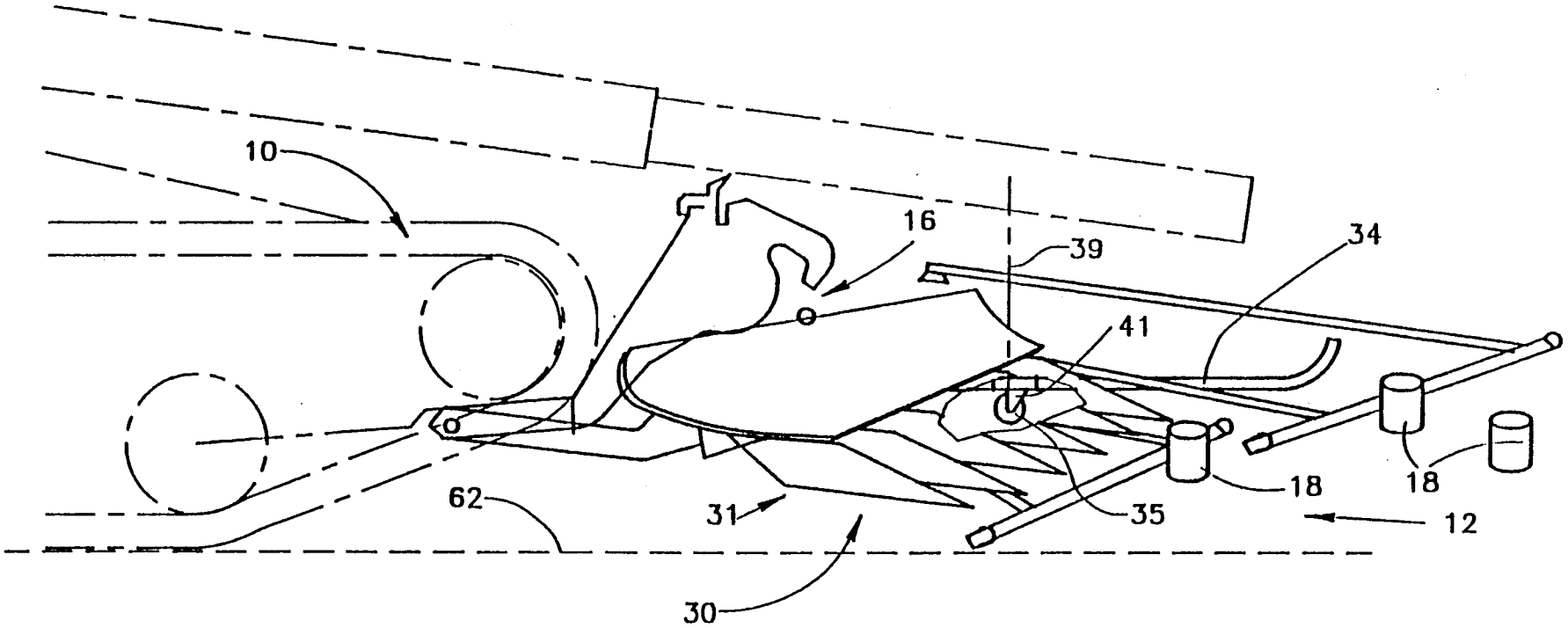

Referring now to FIGS. 5A and 5B, scattered mine clearing apparatus 12 and mine field plowing apparatus 30 are shown in raised and lowered positions respectively. When vehicle 10 is not being used for mine clearing purposes, apparatuses 12 and 30 are raised, whereas in the position depicted in FIG. 5B the apparatus has been lowered towards a pavement surface 62 so as to be used for clearing scattered mines, as described below in conjunction with FIG. 6.

In the present embodiment, wherein scattered mine clearing apparatus 12 is mounted onto portions of the plowing apparatus 30, lifting apparatus 16 (FIG. 1) is constituted by apparatus such as that described in U.S. Pat. No. 4,467,694 used for raising and lowering plowing apparatus 30 thereof.

Referring now to FIG. 6, the clearing of scattered mines 18 from pavement surface 62 is depicted schematically. As the vehicle travels forward in a direction indicated by arrow 64, each of the illustrated mines 18 is engaged successively by one of the tensioned elongate members 26 so as to be deflected sideways, as indicated by arrows 65. A typical deflection path of single deflected mines is shown by a series 66 of broken line circles, each mine being propelled sideways with sufficient force so as to clear edge 68 of the pavement surface 62.

Figure 7A:
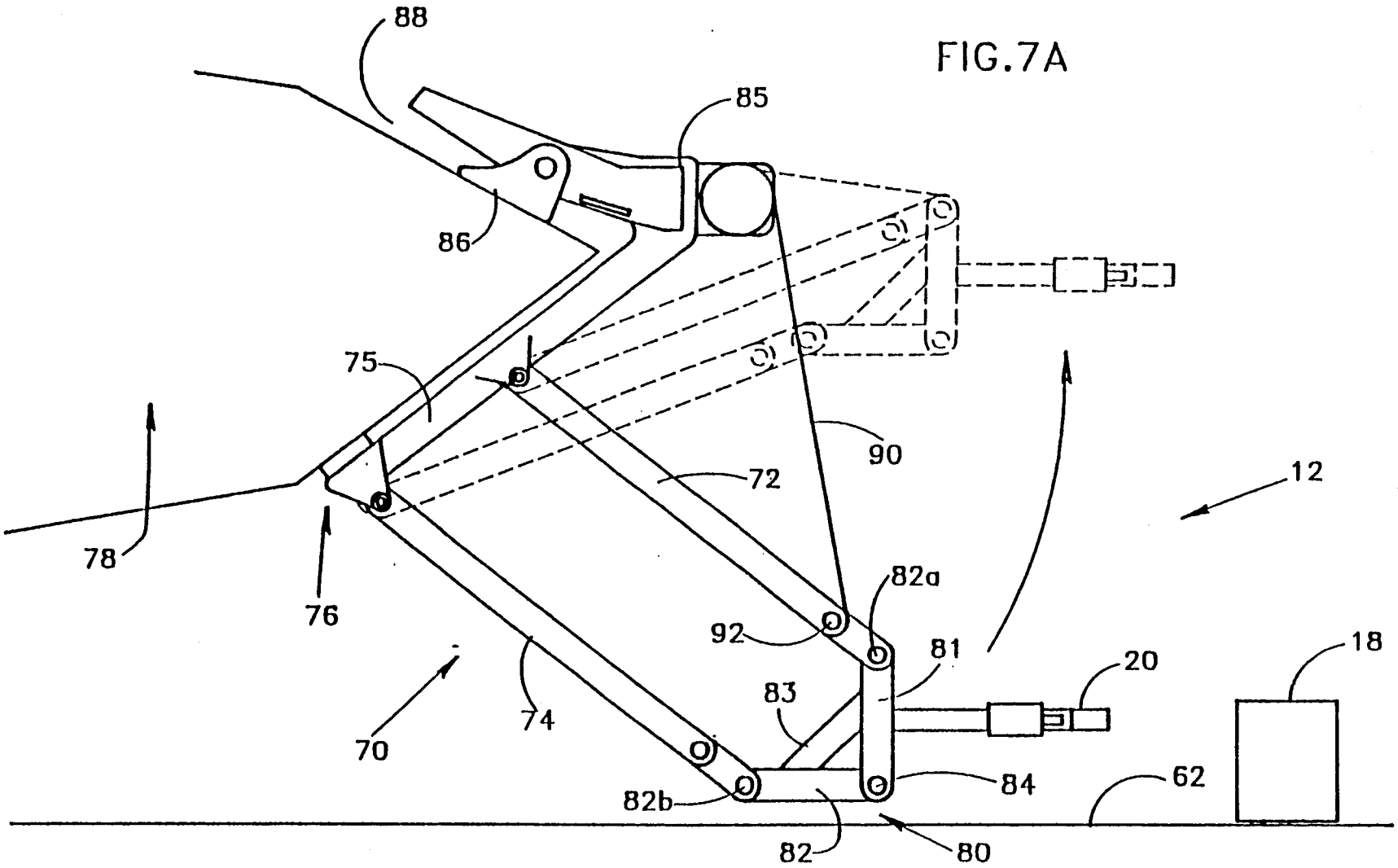
FIGS. 7A and 7B are respective, schematic side and partial plan view illustrations of apparatus for clearing scattered mines, constructed in accordance with an alternative embodiment of the invention.
Figure 7B:
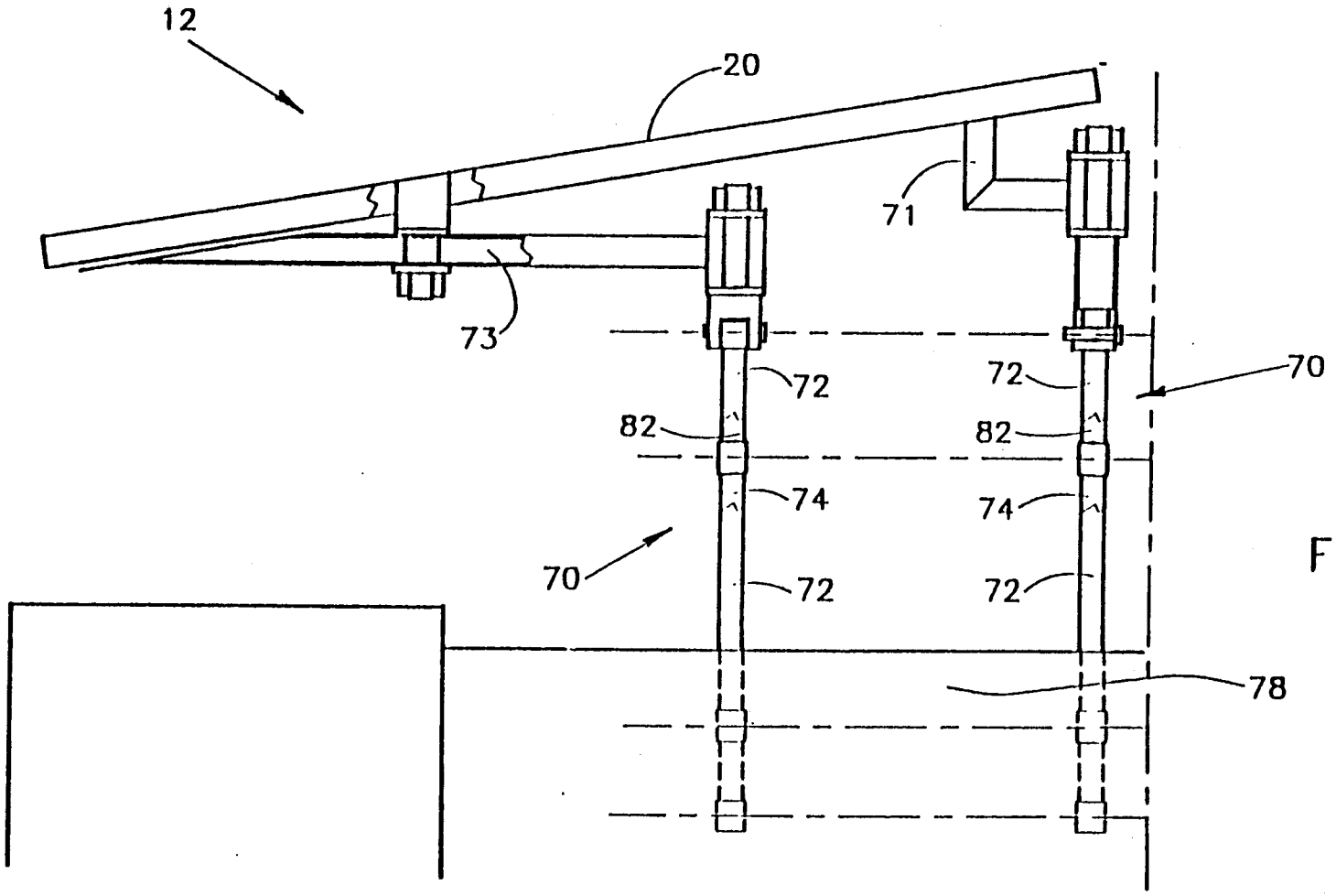

Reference is now made to FIGS. 7A and 7B, in which are shown different views of apparatus 12 for clearing scattered mines, constructed and operative in accordance with an alternative embodiment of the invention. According to the present embodiment, support apparatus 14 (FIG. 1) is constituted by an arrangement of four bar systems 70 to which mine clearing members 20 (of which a single one is illustrated in the present example), are attached by appropriate connector members 71 and 73 (FIG. 7B).

The four bar system 70 includes upper and lower, similar length, elongate members, respectively referenced 72 and 74, each of which is hingedly connected to a transverse mounting member 75 (FIG. 7A) attached to the underside 76 of the vehicle hull 78 and constituting the third element of the four bar system. A triangular link arrangement 80, which constitutes the fourth element of the four bar system comprises a pair of links 81 an 82 and a cross link 83. Links 81 and 82 are connected together at an apex location 84 and are further, rigidly connected together by cross link 83. Link arrangement 80 is connected to the elongate members 72 and 74 at respective hinge locations **82*a* and 82*b***.

Mine clearing member 20 is rigidly mounted onto the four bar system 70 via link 81 which, according to the present embodiment, is maintained continuously in an orientation at right angles to pavement surface 62 (FIG. 7A).

Lifting apparatus 16 (FIG. 1) is constituted in the present embodiment by a lifting device 85 (FIG. 7A) mounted via a mount 86 onto an upper portion 88 of the vehicle hull 78. The lifting device 85 is also mounted onto an upwardly extending portion of transverse mounting member 75. Lifting device may be any suitable lifting apparatus, although in the present example it is an electrical winch connected to the four bar system 70 via a cable 90 attached to a hook member 92 fixed to upper elongate member 72. Operation of the winch in a first direction causes taking up of the cable so as to raise the mine clearing member 20 into the position shown by broken lines in FIG. 7A. Operation of the winch in an opposite, second direction, permits paying out of the cable and, therefore, lowering of the mine clearing member 20 under its own weight and the weight of the four bar system.

It will be appreciated that an advantage of the present embodiment is that due to its relatively light weight (when compared with the combined system of FIGS. 2–6) it may used in conjunction with not only tanks or other heavy armored vehicles, but, with minor modifications, it may also be used in conjunction with other vehicles such as trucks.

It will also be appreciated by persons skilled in the art that the scope of the present invention is not limited to what has been particularly shown and described hereinabove, by way of example. The scope of the present invention is limited, rather, solely by the claims, which follow.

We claim:

1. Vehicle mountable apparatus for clearing mines located on a pavement surface comprising:

at least one tensioned elongate member, associated with a vehicle travelling along the pavement surface in a travel direction, for engaging mines located on the pavement surface in the path of the vehicle so as to propel them away from the vehicle in a direction transverse to the travel direction, thereby clearing a safely traversable path along the pavement surface.

2. Apparatus according to claim 1, and also comprising means for mounting said at least one tensioned elongate member onto the vehicle in a position generally parallel to the pavement surface and at a predetermined angular orientation relative to the travel direction, including means for suporting said at least one tensioned elongate member at a predetermined height above the pavement surface.

3. Apparatus according to claim 2, and wherein said at least one tensioned elongate member comprises:

tensioned wire means; and means, attached to said means for mounting, for retaining said tensioned wire means under tension.

4. Apparatus according to claim 2, and wherein said means for supporting said at least one tensioned elongate member at a predetermined height above the pavement surface also comprises means for raising said at least one elongate member away from the pavement surface out of potential engagement with mines located thereon, and for lowering said at least one elongate member toward the pavement surface to said predetermined height thereabove.

5. Apparatus according to claim 4, and wherein said means for mounting and supporting comprises a four bar system mounted onto the vehicle.

6. Apparatus according to claim 4, and wherein said means for mounting and supporting comprises mine field plowing means and said means for raising and lowering comprises means for raising and lowering said mine field plowing means.

7. Mobile apparatus for clearing mines located on a pavement surface comprising:

a vehicle operative to travel across the pavement surface in a travel direction; and at least one tensioned elongate member, associated with said vehicle, for engaging mines located on the pavement surface in the path of the vehicle so as to propel them away from the vehicle in a direction transverse to the travel direction, thereby clearing a safely traversable path along the pavement surface.

8. Apparatus according to claim 7, and also comprising means for mounting said at least one tensioned elongate member onto a front portion of said vehicle so as to extend across at least a major portion of the width thereof.

9. Apparatus according to claim 7 and also comprising means for mounting said at least one tensioned elongate member onto the vehicle in a position generally parallel to the pavement surface and at a predetermined angular orientation relative to the travel direction, including means for supporting said at least one tensioned elongate member at a predetermined height above the pavement surface.

10. Apparatus according to claim 9, and wherein said at least one tensioned elongate member comprises:

tensioned wire means; and means, attached to said means for mounting, for retaining said tensioned wire means under tension.

11. Apparatus according to claim 9, and wherein said means for supporting said at least one tensioned elongate member at a predetermined height above the pavement surface also comprises means for raising said at least one elongate member away from the pavement surface out of potential engagement with mines located thereon, and for lowering said at least one elongate member toward the pavement surface to said predetermined height thereabove.

12. Apparatus according to claim 11, and wherein said means for mounting and supporting comprises a four bar system mounted onto the vehicle.

13. Apparatus according to claim 11, and wherein said means for mounting and supporting comprises mine field plowing means and said means for raising and lowering comprises means for raising and lowering said mine field plowing means.

* * * * *